US006742577B2

(12) United States Patent
Joboji et al.

(10) Patent No.: US 6,742,577 B2
(45) Date of Patent: Jun. 1, 2004

(54) LAMINATE TYPE EVAPORATOR

(75) Inventors: Yasunobu Joboji, Aichi (JP); Koji Nakado, Aichi (JP); Katsuhiro Saito, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/319,662

(22) Filed: Dec. 16, 2002

(65) Prior Publication Data

US 2003/0127217 A1 Jul. 10, 2003

(30) Foreign Application Priority Data

Jan. 10, 2002 (JP) ..... 2002-003716

(51) Int. Cl.[7] ..... F28D 1/02; F28D 7/06; F28F 9/02

(52) U.S. Cl. ..... 165/153; 165/174; 165/176

(58) Field of Search ..... 165/153, 174, 165/176, 165, 166; 62/519, 524

(56) References Cited

U.S. PATENT DOCUMENTS 5,099,913 A * 3/1992 Kadle ..... 165/153
5,511,611 A * 4/1996 Nishishita ..... 165/153
5,678,422 A * 10/1997 Yoshii et al. ..... 62/513
5,680,773 A * 10/1997 Aikawa et al. ..... 62/526
5,701,760 A * 12/1997 Torigoe et al. ..... 62/524
5,735,343 A * 4/1998 Kajikawa et al. ..... 165/153
5,906,237 A * 5/1999 Aikawa ..... 165/153
5,931,020 A * 8/1999 Nakamura ..... 62/527
6,516,486 B1 * 2/2003 Mehendale et al. ..... 62/503

FOREIGN PATENT DOCUMENTS

JP 9-33138 2/1997
JP 9-170850 6/1997
JP 410170098 A * 6/1998

* cited by examiner

*Primary Examiner*—Henry Bennett
*Assistant Examiner*—Tho Duong
(74) *Attorney, Agent, or Firm*—Oblon, Spivak, McClelland, Maier & Neustadt, P.C.

(57) ABSTRACT

At the refrigerant inlet/outlet side surface portion of laminated flat tubes, there is provided a first side refrigerant passage, and in the upper portion of the other side surface portion, there is provided a second side refrigerant passage, and in the lower portion thereof a third side refrigerant passage. A first partition portion is provided in first lower tank portions of the laminated flat tubes, and a second partition portion is provided in second upper tank portions. The first partition portion and the second partition portion respectively divide the laminated first lower tank portions and the second upper tank portions such that the ratio of the number of flat tubes on the refrigerant inlet/outlet side surface portion side, n4, to the number of flat tubes on the opposite side surface portion side, n3, is approximately 2:1.

9 Claims, 10 Drawing Sheets

LAMINATE TYPE EVAPORATOR

BACKGROUND OF THE INVENTION

1. Field of the Invention

The present invention relates to a laminate type evaporator for an air conditioner.

2. Description of the Related Art

FIG. 9 is a perspective view showing the refrigerant flow passage construction of a conventional laminate type evaporator, FIG. 10 is a plan view of a flat tube used in a laminate type evaporator that constitutes a refrigerant pipe through which refrigerant is passed, and FIG. 11 is an exploded perspective view of the flat tube.

In the laminate type evaporator 1 shown in FIG. 9, a large number of flat tubes 2 as shown in FIG. 10 are arranged in parallel at intervals, and corrugate fins (not shown) are provided between the adjacent flat tubes 2, whereby the flat tubes 2 and the corrugate fins are alternately laminated together; in the laminated state, these components are integrally brazed to each other.

As shown in FIG. 11, each flat tube 2 is composed of a pair of press-molded plates 2*a* and 2*b* with their ends being deep-drawn; the pair of plates are opposed and joined to each other. At the top end of the flat tube, there are formed in parallel a first upper tank portion 31 and a second upper tank portion 32 constituting an inlet side or an outlet side for refrigerant. At the lower end of the flat tube, there are formed in parallel a first lower tank portion 41 and a second lower tank portion 42 constituting the inlet side or the outlet side for refrigerant.

These tank portions are formed by joining together the molded plates 2*a* and 2*b* opposed to each other. That is, the first upper tank portion 31 is formed by joining together a tank forming portion 31*a* of the molded plate 2*a* and a tank forming portion 31*b* of the molded plate 2*b*, and the second upper tank portion 32 is formed by joining together a tank forming portion 32*a* of the molded plate 2*a* and a tank forming portion 32*b* of the molded plate 2*b*. Further, the first lower tank portion 41 is formed by joining together a tank forming portion 41*a* of the molded plate 2*a* and a tank forming portion 41*b* of the molded plate 2*b*, and the second lower tank portion 42 is formed by joining together a tank forming portion 42*a* of the molded plate 2*a* and a tank forming portion 42*b* of the molded plate 2*b*.

From the portion between the first upper tank portion 31 and the second upper tank portion 32 to the portion between the first lower tank portion 41 and the second lower tank portion 42, there extends a partition 6, which is formed by joining together the bottom surfaces of a partition groove 6*a* of the molded plate 2*a* and a partition groove 6*b* of the molded plate 2*b*. By this partition 6, there are defined two flow passages through which refrigerant flows: a first refrigerant flow passage 51 and a second refrigerant flow passage 52. The first refrigerant flow passage 51 is a linear flow passage connecting the first upper tank portion 31 and the first lower tank portion 41; it is formed between a refrigerant flow passage forming portion 51*a* of the molded plate 2*a* and a refrigerant flow passage forming portion 51*b* of the molded plate 2*b*. Further, the second refrigerant flow passage 52 is a linear flow passage connecting the second upper tank portion 32 and the second lower tank portion 42; it is formed between a refrigerant flow passage forming portion 52*a* of the molded plate 2*a* and a refrigerant flow passage forming portion 52*b* of the molded plate 2*b*.

In this way, the laminate type evaporator 1 is formed by alternately laminating together a large number of flat tubes 2 and corrugate fins. Further, as shown in FIG. 9, a side refrigerant passage 3 is provided at one refrigerant inlet/outlet side surface portion 1F of the laminated flat tubes 2. Further, a side refrigerant passage 4 is provided at the other side surface portion 1B. At the position of the side refrigerant passage 3 in the vicinity of the first upper tank portion 31, there is provided a refrigerant inlet Rin through which refrigerant flows into the laminate type evaporator 1. Further, at the position of the side refrigerant passage 3 in the vicinity of the second upper tank portion 32, there is provided adjacent to the refrigerant inlet Rin a refrigerant outlet Rout through which refrigerant flows out of the laminate type evaporator 1. The side refrigerant passage 3 communicates with the refrigerant inlet Rin and the first lower tank portion 41 of that flat tube 2 out of the laminated flat tubes 2, which is nearest to the side refrigerant passage 3 side.

Further, in the middle portion with respect to the laminating direction of the first lower tank portion 41 of the laminated flat tubes 2, there is provided a partition portion 18. Here, the partition portion 18 is formed such that no refrigerant communicates between the lower tank portions 41 of the adjacent flat tubes 2 with the partition portion 18 therebetween. In the middle portion of the second upper tank portion 32 of the laminated flat tubes 2, there is provided a partition portion 19. The partition portion 19 is formed such that no refrigerant communicates between the second upper tank portions 32 of the adjacent flat tubes 2 with the partition portion 19 therebetween.

In this way, the partition portions 18 and 19 respectively divide the first lower tank portions 41 and the second upper tank portions 32 laminated together such that the ratio of the number n2 of flat tubes on the refrigerant inlet/outlet side surface portion 1F side to the number n1 of flat tubes on the opposite side, i.e., on the side surface portion 1B side, is substantially 1:1.

Of the first refrigerant passages 51 of the flat tubes 2 laminated together and the first upper tank portions 31 and the first lower tank portions 41 at the ends thereof, those situated on the side refrigerant passage 3 side with respect to the partition portion 18 constitute a first block B1 in which refrigerant flows as refrigerant flow R1 from the first lower tank portions 41 to the first upper tank portions 31. Of the first refrigerant passages 51 of the flat tubes 2 laminated together and the first upper tank portions 31 and the first lower tank portions 41 at the ends thereof, those situated on the side refrigerant passage 4 side with respect to the partition portion 18 constitute a second block B2 in which refrigerant flows as refrigerant flow R2 from the first upper tank portions 31 to the first lower tank portions 41.

Further, of the second refrigerant passages 52 of the flat tubes 2 laminated together and the second upper tank portions 32 and the second lower tank portions 42 at the ends thereof, those situated on the side refrigerant passage 4 side with respect to the partition portion 19 constitute a third block B3 in which refrigerant flows as refrigerant flow R3 from the second upper tank portions 32 to the second lower tank portions 42. Of the second refrigerant passages 52 of the flat tubes 2 laminated together and the second upper tank portions 32 and the second lower tank portions 42 at the ends thereof, those situated on the side refrigerant passage 3 side with respect to the partition portion 19 constitute a fourth block B4 in which refrigerant flows as refrigerant flow R4 from the second lower tank portions 42 to the second upper tank portions 32.

In the laminate type evaporator 1, constructed as described above, refrigerant flowing in through the refrigerant inlet Rin passes through the side refrigerant passage 3 as a refrigerant flow RSA, and enters an inlet side tank portion 10 consisting of the first lower tank portions 41 in the first block B1. Next, it flows through the first refrigerant passages 51 of the first block B1 as refrigerant flow R1, and enters an outlet side tank portion 11 consisting of the first upper tank portions 31 in the first block B1. The refrigerant that has flowed into the outlet side tank portion 11 of the first block enters an inlet side tank portion 12 consisting of the first upper tank portions 31 in the second block B2, and flows through the first refrigerant passages 51 of the second block B2 as refrigerant flow R2 before entering an outlet side tank portion 13 consisting of the first lower tank portions 41 in the second block B2. Thereafter, the refrigerant passes through the side refrigerant passage 4 as refrigerant flow RSB, and enters an inlet side tank portion 14 consisting of the second upper tank portions 32 in the third block B3. The refrigerant that has flowed into the inlet side tank portion 14 flows through the second refrigerant passages 52 of the third block B3 as refrigerant flow R3, and enters an outlet side tank portion 15 consisting of the second lower tank portions 42 in the third block B3. The refrigerant that has flowed into the outlet side tank portion 15 enters an inlet side tank portion 16 consisting of the second lower tank portions 42 in the fourth block B4, and flows through the second refrigerant passages 52 of the fourth block B4 as refrigerant flow R4 before entering an outlet side tank portion 17 consisting of the second upper tank portions 32 in the fourth block B4. Thereafter, it flows out from the refrigerant outlet Rout connected to the outlet side tank portion 17.

However, in the laminate type evaporator 1 constructed as described above, when reducing the width of the flat tubes 2 corresponding to the flow direction 100 shown in FIG. 9 to reduce the width of the core formed by laminating together the flat tubes 2 and the corrugate fins in order to achieve a reduction in size and cost, the flow passage sectional areas of the first refrigerant flow passages 51 and the second refrigerant flow passages in the flat tubes 2 are reduced due to the division of the refrigerant flow passages of the flat tubes 2 into four blocks. When the flow passage sectional area is reduced, the refrigerant pressure loss in the flat tubes 2 increases, so that the refrigerant pressure loss of the laminate type evaporator 1 increases, resulting in a deterioration in performance in refrigeration cycle operation.

SUMMARY OF THE INVENTION

The present invention has been made with a view toward solving the above problem in the prior art. It is an object of the present invention to provide a laminate type evaporator in which the refrigerant tubes are reduced in width while reducing the refrigerant pressure loss of the laminate type evaporator, thereby making it possible to achieve a reduction in size and cost.

According to the present invention, there is provided a laminate type evaporator in which a large number of refrigerant tubes including at least a pair of first and second refrigerant flow passages are laminated together, the laminate type evaporator characterized by comprising: a refrigerant tube group in which a pair of first and second upper tank portions are respectively arranged at one end of the first and second refrigerant flow passages and in which a pair of first and second lower tank portions are respectively arranged at the other end of the first and second flow passages; a refrigerant inlet arranged on the first upper tank portion side of the refrigerant tube at one end of the refrigerant tube group; a refrigerant outlet arranged on the second upper tank portion side of the refrigerant tube at said one end; a first side refrigerant passage communicating the refrigerant inlet with the first lower tank portion of the refrigerant tube at said one end; a second side refrigerant passage communicating the first upper tank portion with the second upper tank portion of the refrigerant tube at the other end of the refrigerant tube group; a third side refrigerant passage communicating the first lower tank portion with the second lower tank portion of the refrigerant tube at said other end; a first partition portion arranged in the first lower tank portions of the refrigerant tube group; and a second partition portion arranged in the second upper tank portions of the refrigerant tube group, and the laminate type evaporator characterized in that the first partition portion and the second partition portion are arranged such that they divide the refrigerant tube group into three refrigerant flow passage groups sequentially circulating refrigerant introduced from the refrigerant inlet from the first lower tank portion of the refrigerant tube at said one end to the second upper tank portion of the refrigerant tube at said one end.

DESCRIPTION OF THE PREFERRED EMBODIMENTS

Embodiments of the present invention will now be described with reference to the accompanying drawings.

Embodiment 1

Figure 1A:
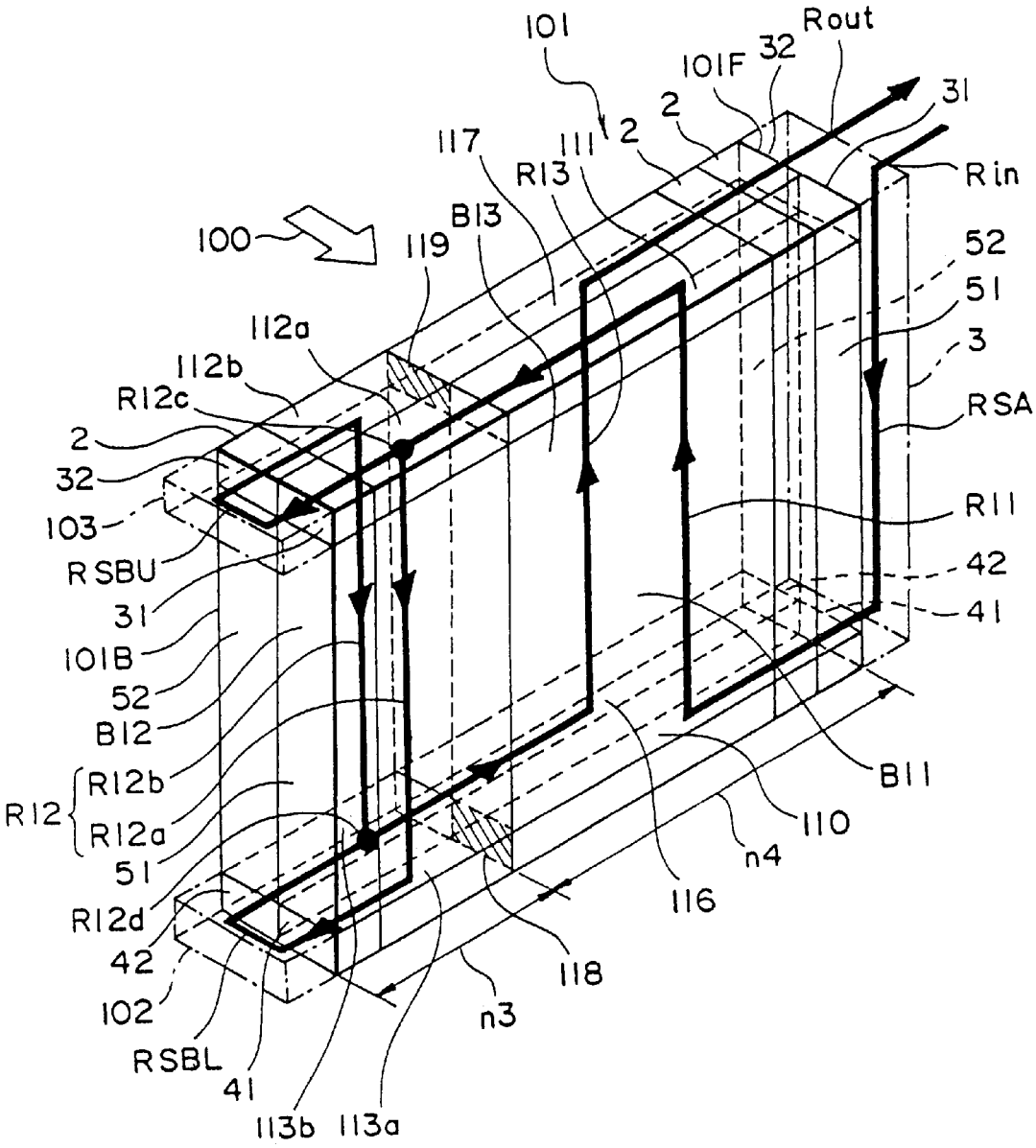
FIG. 1A is a perspective view showing the refrigerant flow passage construction of a laminate type evaporator according to Embodiment 1.
Figure 10:
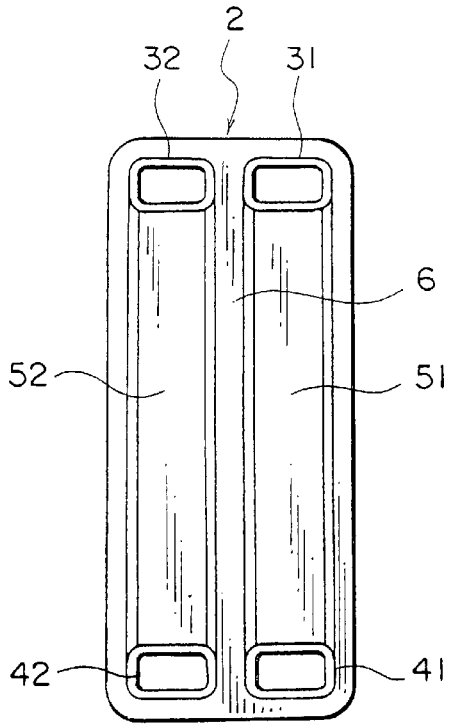
FIG. 10 is a plan view of a flat tube forming a conventional laminate type evaporator.
Figure 11:
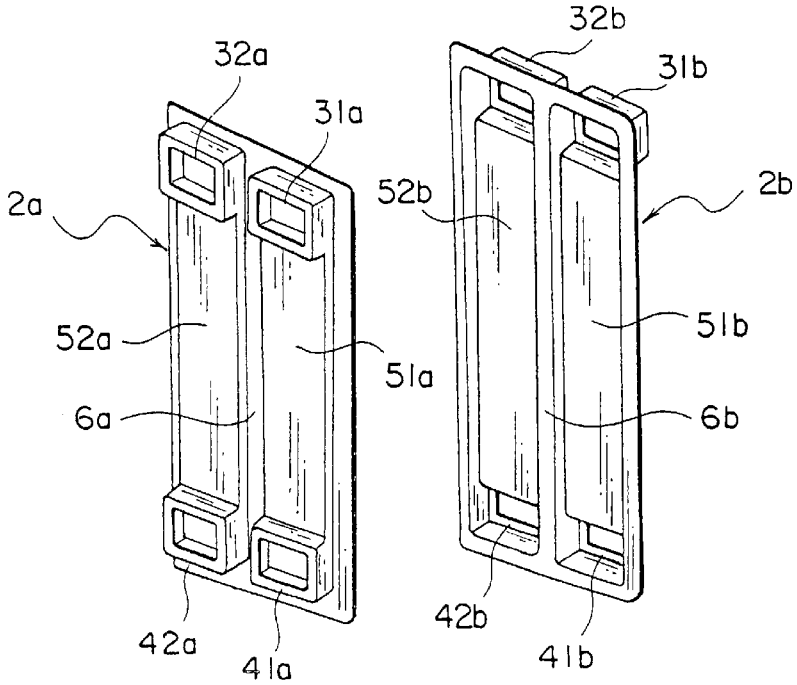
FIG. 11 is an exploded perspective view of the flat tube of FIG. 10.

As shown in FIG. 1A a laminate type evaporator 101 according to Embodiment 1 of the present invention is formed by alternately laminating together and integrally brazing to each other a large number of flat tubes 2 as refrigerant tubes each consisting of molded plates 2*a* and 2*b* shown in FIGS. 10 and 11 and corrugate fins (not shown).

Thus, in the flat tube 2, the first upper tank portion 31, the second upper tank portion 32, the first lower tank portion 41, the second lower tank portion 42, the first refrigerant flow passage 51 connecting the first upper tank portion 31 and the first lower tank portion 41, and the second refrigerant flow passage 52 connecting the second upper tank portion 32 and the second lower tank portion 42 are of the same construction as the conventional laminate type evaporator.

The laminated flat tubes 2 shown in FIG. 1A constitute a refrigerant tube group; in the drawing, the second upper tank portions 32, the second refrigerant passage 52, and the second lower tank portions 42 are situated on the upstream side with respect to the flowing direction 100 of air constituting the external fluid.

At the refrigerant inlet/outlet side surface portion 101F constituting one side surface of the laminated flat tubes 2 situated on the back side as seen in FIG. 1A there is provided a first side refrigerant passage 3. Further, in the upper portion of the other side surface portion 101B on the front side, there is provided a second side refrigerant passage 103, and, in the lower portion thereof, there is provided a third side refrigerant passage 102.

In the side refrigerant passage 3, a refrigerant inlet Rin through which refrigerant flows into the laminate type evaporator 101 is provided in the extension of the laminated first upper tank portions 31. Further, in the extension of the laminated second upper tank portions 32, there are provided a refrigerant outlet Rout through which refrigerant flows out of the laminate type evaporator 101 and a refrigerant inlet Rin so as to be adjacent to each other. Here, the refrigerant inlet Rin and the refrigerant outlet Rout are arranged in parallel such that the refrigerant outlet Rout is on the upstream side of the refrigerant inlet Rin with respect to the flowing direction 100 of the external fluid. Further, the side refrigerant passage 3 communicates with the refrigerant inlet Rin and the first lower tank portion 41 of the flat tube 2 on the laminated flat tubes 2 which is nearest to the side refrigerant passage 3 side.

Further, a first partition portion 118 is provided in the first lower tank portion 41 of one of the laminated flat tubes 2. The first partition portion 118 is arranged such that, assuming that the total number of flat tubes 2 laminated together is N, approximately ⅔ of N flat tubes 2 are contained between the refrigerant inlet/outlet side surface portion 101F and the first partition portion 118 and that no refrigerant communicates between the first lower tank portions 41 of the flat tubes 2 adjacent to each other with the first partition portion 118 therebetween.

Further, a second partition portion 119 is provided in the second upper tank portion 32 of the laminated flat tubes 2. Like the first partition portion 118, the second partition portion 119 is arranged such that approximately ⅔ of the N flat tubes 2 are contained on the side refrigerant passage 3 side between the refrigerant inlet/outlet side surface portion 101F and the second partition portion 119, and that no refrigerant communicates between the second upper tank portions 32 of the flat tubes 2 adjacent to each other with the second partition portion 119 therebetween.

Thus, the first partition portion 118 and the second partition portion 119 divide the first lower tank portions 41 and the second upper tank portions 32 such that the ratio of the number of flat tubes laminated on the refrigerant inlet/outlet side surface portion 101F side, n4, to the number of flat tubes laminated on the opposite, the side surface portion 101B side, n3, is approximately 2:1.

The side refrigerant passage 103 is constructed such that the first upper tank portions 31 and the second upper tank portions 32 of the flat tubes 2 positioned on the side refrigerant passage 102 side with respect to the second partition portion 119 communicate with each other. Further, the side refrigerant passage 102 is constructed such that the first lower tank portions 41 and the second lower tank portions 42 of the flat tubes 2 positioned on the side refrigerant passage 102 side with respect to the first partition portion 118 communicate with each other.

Of the first refrigerant flow passages 51 and the first upper tank portions 31 and the first lower tank portions 41 at the ends thereof, those situated on the side refrigerant passage 3 side with respect to the first partition portion 118 constitute a first block B11 in which refrigerant flows from the first lower tank portions 41 to the first upper tank portions 31 as refrigerant flow R11. Of the first refrigerant flow passages 51, the second refrigerant flow passages 52 and the first upper tank portions 31, the first lower tank portions 41, the second upper tank portions 32, and the second lower tank portions 42 at the ends thereof, those situated on the refrigerant passage 102 side and the refrigerant passage 103 side with respect to the first partition portion 118 and the second partition portion 119, respectively, constitute a second block B12. In the first refrigerant flow passages 51 contained in the second block B12, refrigerant flows from the first upper tank portions 31 to the first lower tank portions 41 as refrigerant flow R12*a*, and in the second refrigerant flow passages 52 contained in the second block B12, refrigerant flows from the second upper tank portions 32 to the first lower tank portions 42 as refrigerant flow R12*b*. The second block B12 is constructed such that a refrigerant flow R12 consisting of refrigerant flows R12*a* and R12*b* is formed.

Further, of the second refrigerant flow passages 52 and the second upper tank portions 32 and the second lower tank portions 42 at the ends thereof of the flat tubes 2 laminated together, those situated on the side refrigerant passage 3 side with respect to the second partition portion 119 constitute a third block B13 in which refrigerant flows from the second lower tank portions 42 to the second upper tank portions 32 as refrigerant flow R13.

Next, the operation of the laminate type evaporator 101 of this embodiment will be described.

The refrigerant flowing in through the refrigerant inlet Rin passes through the side refrigerant passage 3 as refrigerant flow RSA, and enters an inlet side tank portion 110 consisting of the first lower tank portions 41 in the first block B11. Next, it flows through the first refrigerant flow passages 51 of the first block B11 as refrigerant flow R11, and enters an outlet side tank portion 111 consisting of the first upper tank portions 31 in the first block B11.

The refrigerant that has flowed in the outlet side tank portion 111 of the first block enters a front half 112*a* of an inlet side tank consisting of the first upper tank portions 31 in the second block B12, and a portion thereof is branched off at a branch point R12*c* of the inlet side tank front half portion 112*a* and the first refrigerant flow passages 51, and flows through the first refrigerant passages 51 of the second block B12 as refrigerant flow R12*a* before entering an outlet side tank front half portion 113*a* consisting of the first lower tank portions 41 in the second block B12. Further, it flows through the side refrigerant passage 102 as refrigerant flow RSBL, and enters an outlet side tank rear half portion 113*b* consisting of the second lower tank portions 42 in the second block B12.

On the other hand, the remaining portion of the refrigerant that has flowed in the first block outlet side tank portion 111 is branched off at the branch point R12*c*, and flows through the side refrigerant passage 103 as refrigerant flow RSBU to enter an inlet side tank rear half portion 112*b* consisting of the second upper tank portions 32 of the second block B12. Then, it flows through the second refrigerant flow passages 52 of the second block B12 as refrigerant flow R12*b*, and enters the outlet side tank rear half portion 113*b*, joining the refrigerant flow R12*a* at a branch point R12*d* of the outlet side tank rear half portion 113*b* and the second refrigerant flow passage 52.

The refrigerant flows joined at the outlet side tank rear half portion 113*b* then enter an inlet side tank portion 116 consisting of the second lower tank portions 42 in the third block B13. The refrigerant that has flowed in the inlet side tank portion 116 flows through the second refrigerant flow passages 52 of the third block B13 as refrigerant flow R13, and enters an outlet side tank portion 117 consisting of the second upper tank portions 32 in the third block B13. The refrigerant that has flowed in the outlet side tank portion 117 flows out from the refrigerant outlet Rout connected to the outlet side tank portion 117.

In this way, the laminate type evaporator 101 is constructed such that the flow passages through which refrigerant flows are divided into three blocks B11, B12, and B13, so that it is possible to reduce the length of the refrigerant flow passage from the refrigerant inlet Rin to the refrigerant outlet Rout. Further, as compared with the case in which the interior is divided into four blocks, the number of first refrigerant flow passages 51 and that of second refrigerant flow passages 52 contained in each block are increased, so that the flow velocity of the refrigerant is reduced.

Thus, due to the reduction in the length of the refrigerant flow passage and the reduction in flow velocity, it is possible to mitigate the pressure loss of the refrigerant passing through the laminate type evaporator 101.

Further, due to the application of a three-block structure, even when the width of the laminate type evaporator 101 is reduced, it is possible to prevent an increase in the pressure loss of the refrigerant due to the reduction of the sectional area of the flow passages in the flat tubes 2, making it possible to reduce the width of the flat tubes 2 to realize a reduction in the core width and to achieve a reduction in the size and cost of the laminate type evaporator 101.

Further, since the three blocks B11, B12, and B13 contain substantially the same number of first and second refrigerant flow passages 51 and 52, it is possible to form a uniform refrigerant flow passage, making it possible to mitigate the increase in the pressure loss of the refrigerant passing through the laminate type evaporator 101.

Embodiment 2

While in the laminate type evaporator 101 of Embodiment 1 each of the blocks B11, B12, and B13 is constituted to contain substantially the same number of first and second refrigerant flow passages 51 and 52, a construction in which the nearer to the refrigerant outlet Rout, the larger the number of first and second refrigerant flow passages 51 and 52 may be adopted.

Figure 1B:
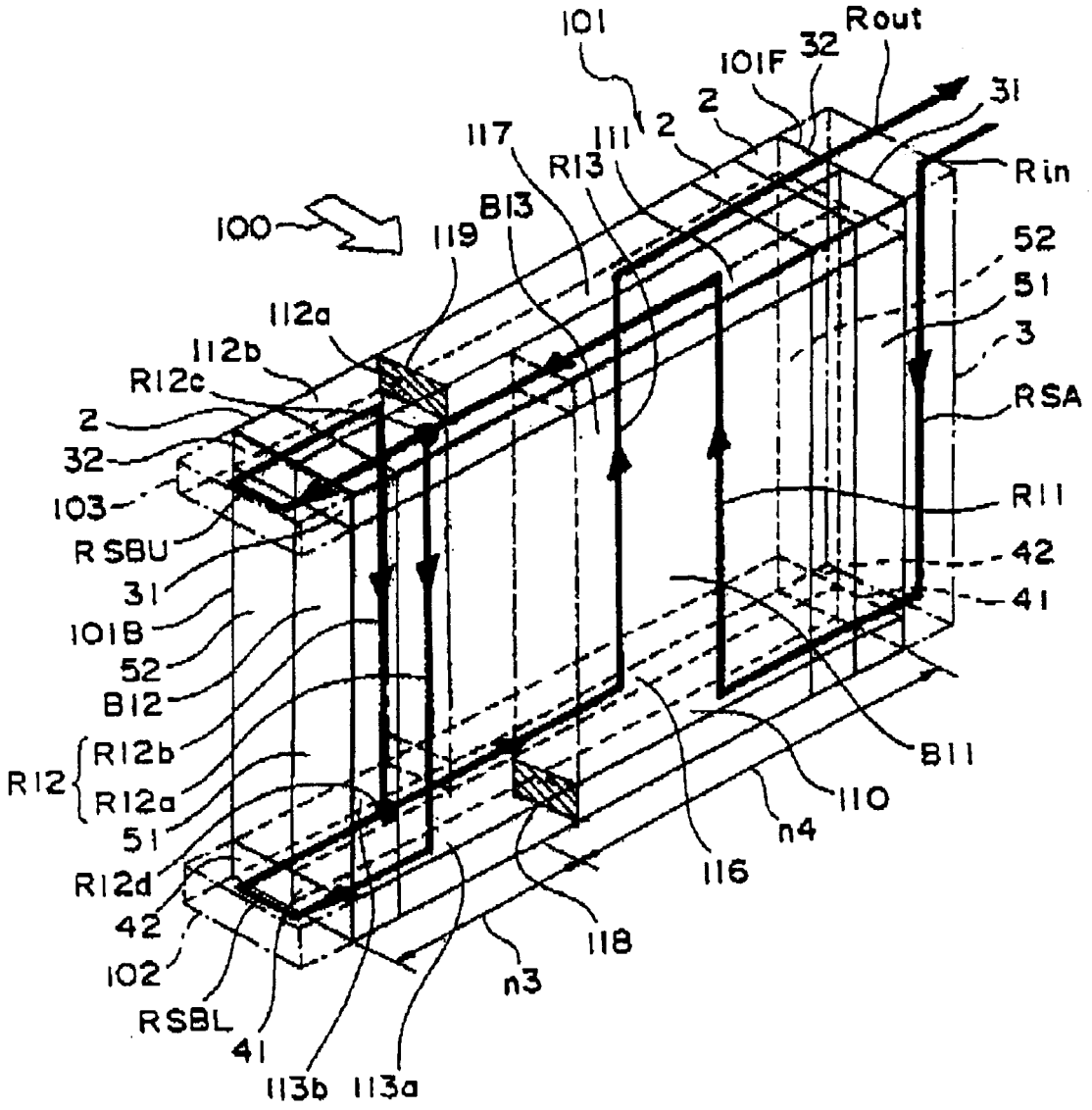
FIG. 1B is a perspective view showing the refrigerant flow passage construction of a laminate type evaporator according to Embodiment 2.

That is, the position of the first partition portion 118 provided in the first lower tank portions 41 shown in FIG. 1A is brought nearer to the refrigerant inlet/outlet side surface portion 101F side, and the position of the second partition portion 119 provided in the second upper tank portions 32 is moved away from the refrigerant inlet/outlet side surface portion 101F toward the side surface portion 101B side. As depicted in Fig. 1B, the first partition portion 118 is arranged nearer to the refrigerant inlet side than a position which leads to inclusion of approximately ⅔ of the refrigerant tubes, and the second partition portion 119 is arranged farther away from the refrigerant outlet side than a position which leads to inclusion of approximately ⅔ of the refrigerant tubes.

Due to this arrangement, although the gas component of the refrigerant of the laminate type evaporator increases in the rear flow area, the total number of first and second refrigerant flow passages 51 and 52 of the flat tubes 2 on the refrigerant outlet Rout side increases, so that it is possible to further mitigate the increase in the pressure loss of the refrigerant.

Embodiment 3

In the laminate type evaporator of Embodiment 3, flat tubes 302 are provided instead of the flat tubes 2 of Embodiments 1 and 2.

Figure 2:
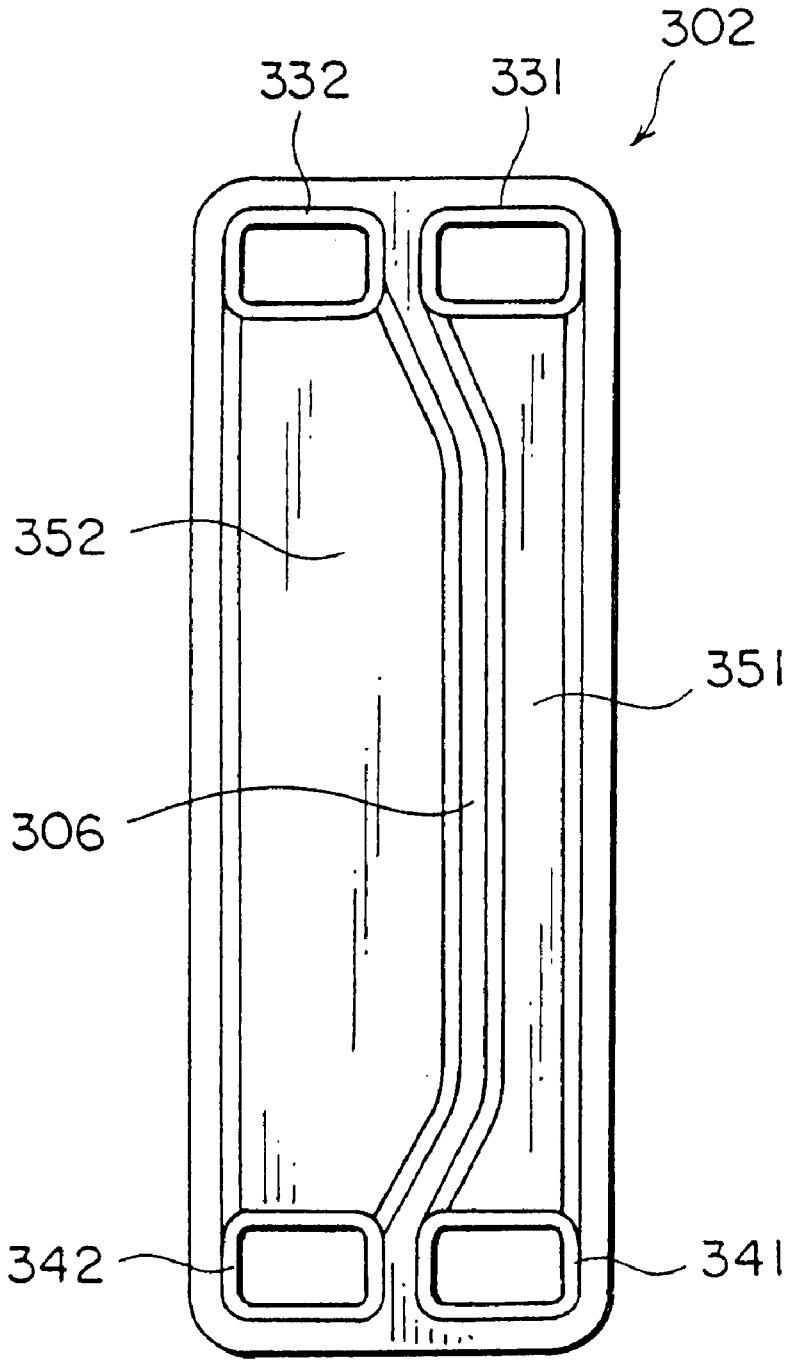
FIG. 2 is a plan view of a flat tube used in a laminate type evaporator according to Embodiment 3.

As shown in FIG. 2, in the flat tube 302, a partition groove 306 is arranged such that the width of a second refrigerant flow passage 352 connecting a second upper tank portion 332 and a second lower tank portion 342 on the refrigerant outlet Rout side is larger than the width of a first refrigerant flow passage 351 connecting a first upper tank portion 331 and a first lower tank portion 341 on the refrigerant inlet Rin side.

Due to this arrangement, the flow passage sectional area increases in the second refrigerant flow passages 352 in the third block B13 where the amount of gas component of the refrigerant is large, making it possible to mitigate the increase in the pressure loss of the refrigerant.

Embodiment 4

In the laminate type evaporator of Embodiment 4, flat tubes 402 are provided instead of the flat tubes 2 of Embodiments 1 and 2.

Figure 3:
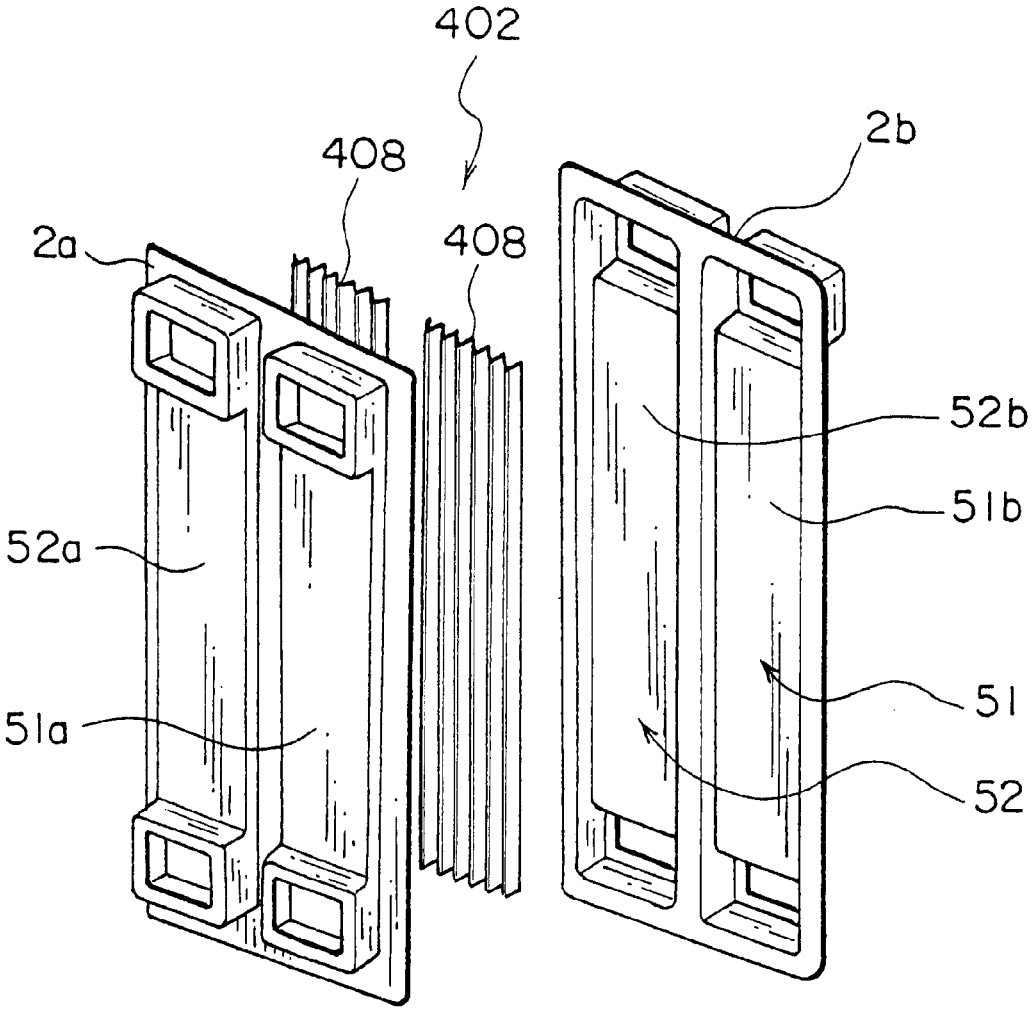
FIG. 3 is an exploded perspective view of a flat tube used in a laminate type evaporator according to Embodiment 4.

As shown in FIG. 3, in the flat tube 402, two inner fins 408 formed as corrugated plates are provided inside the pair of molded plates 2*a* and 2*b* constituting the flat tube 2.

One inner fin 408 is held between the refrigerant flow passage forming portion 51*a* of the molded plate 2*a* and the refrigerant flow passage forming portion 51*b* of the molded plate 2*b*, and the other inner fin 408 is held between the refrigerant flow passage forming portion 52*a* of the molded plate 2*a* and the refrigerant flow passage forming portion 52*b* of the molded plate 2*b*.

Due to this arrangement, an inner fin 408 is provided in each of the first refrigerant flow passage 51 and the second refrigerant flow passage 52, so that the heat transfer area on the refrigerant side increases, thereby improving the heat exchange performance of the laminate type evaporator.

It is also possible to provide inner fins 408 in the flat tubes 302 used in the laminate type evaporator of Embodiment 3.

Embodiment 5

In the laminate type evaporator of Embodiment 5, a flat tube 502 is provided instead of the flat tube 2 used in the laminate type evaporators of Embodiments 1, 2, and 4.

Figure 4:
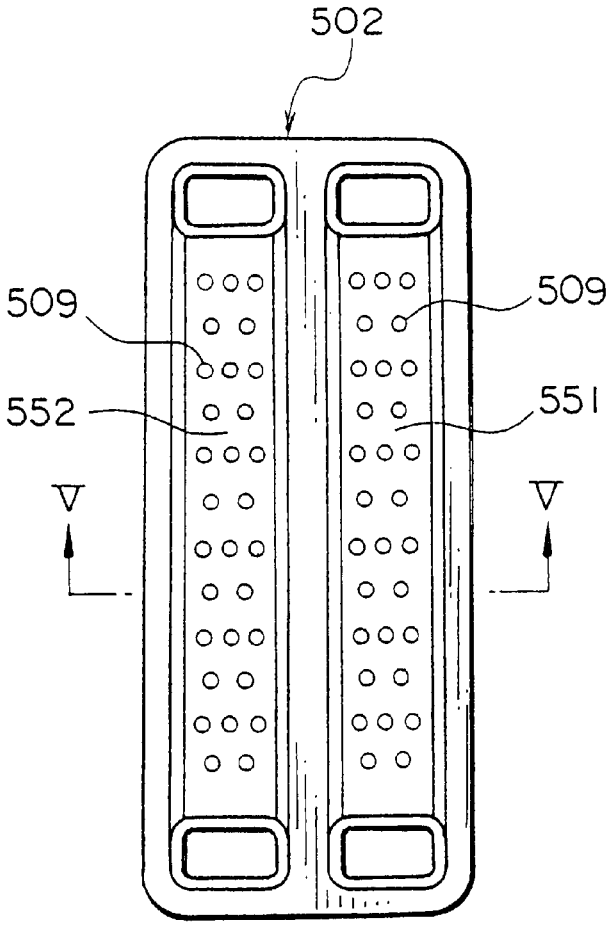
FIG. 4 is a plan view of a flat tube used in a laminate type evaporator according to Embodiment 5.
Figure 5:
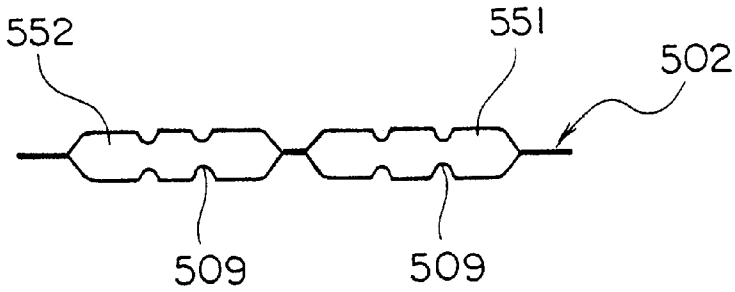
FIG. 5 is a sectional view taken along the line V—V of FIG. 4.

As shown in FIGS. 4 and 5, the flat tube 502 has on the inner surfaces of the first refrigerant flow passage 551 and the second refrigerant flow passage 552 a plurality of protrusions 509 directed toward the flow passage side.

Due to this arrangement, turbulence is generated in the refrigerant flow in the first refrigerant flow passage 551 and the second refrigerant flow passage 552, and heat conduction is promoted, whereby the heat exchange performance of the laminate type evaporator is improved.

It is also possible to provide the above-mentioned plurality of protrusions 509 on both sides of the first refrigerant flow passage 351 and the second refrigerant flow passage 352 of the flat tube 302 used in the laminate type evaporator of Embodiment 3.

Embodiment 6

In the laminate type evaporator of Embodiment 6, a flat tube 602 is provided instead of the flat tube 2 used in the laminate type evaporators of Embodiments 1, 2, and 4.

Figure 6:
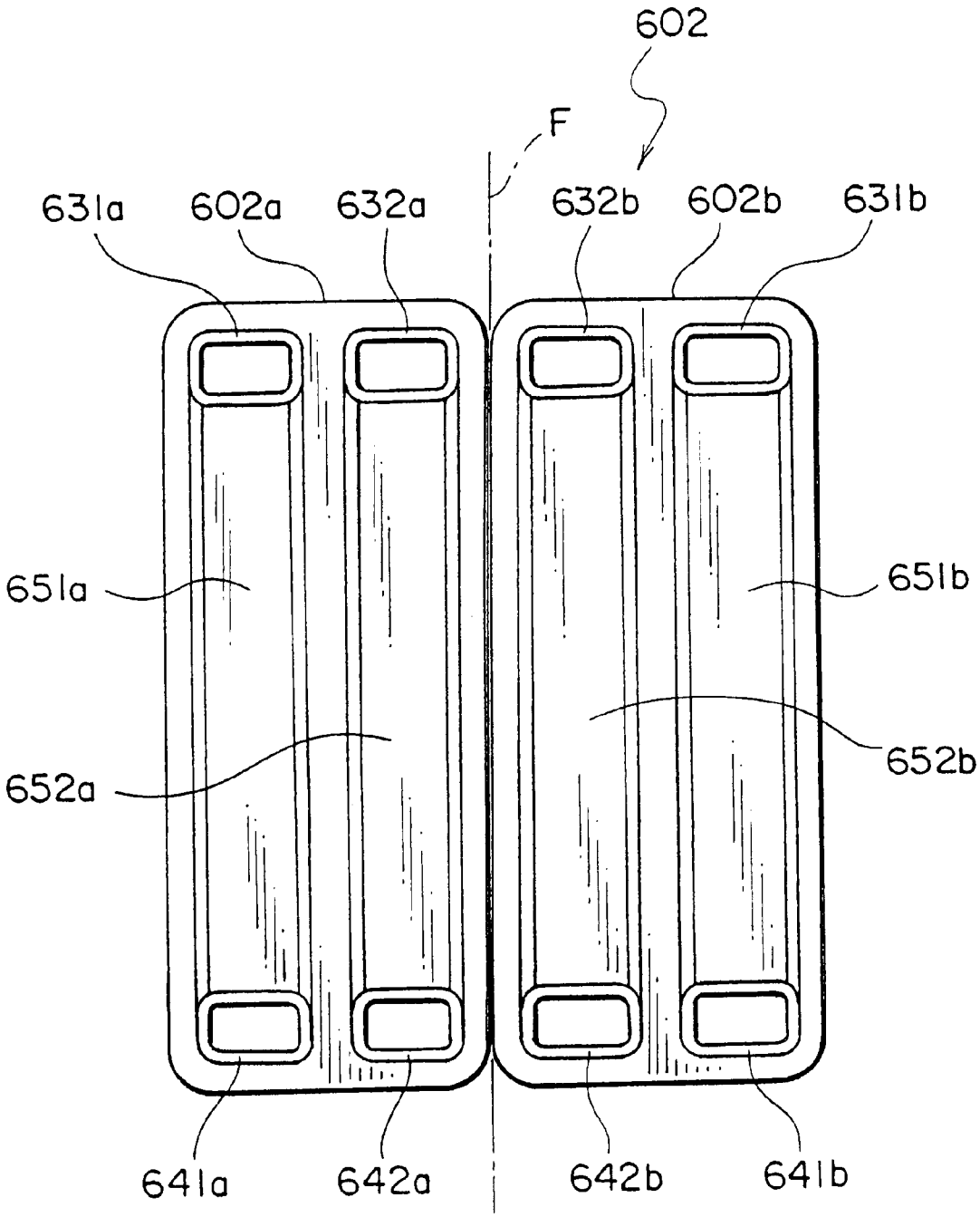
FIG. 6 is a plan development of a flat tube used in a laminate type evaporator according to Embodiment 6, showing it in the condition before bending.

As shown in FIG. 6, the flat tube 602 consists of linearly symmetrical molded plate portions 602*a* and 602*b* integrally formed by press-molding, and the plate portions 602*a* and 602*b* have on either side of a center line F constituting the symmetry line, tank forming portions 631*a* and 631*b* forming a first upper tank portion, tank forming portions 632*a* and 632*b* forming a second upper tank portion, tank forming portions 641*a* and 641*b* forming a first lower tank portion, tank forming portions 642*a* and 642*b* forming a second lower tank portion, and refrigerant flow passage forming portions 651*a*, 651*b* and 652*a*, 652*b*, the plate portions 602*a* and 602*b* being folded along the center line F.

Due to this arrangement, it is possible to reduce the number of components of the flat tubes forming the laminate type evaporator, thereby achieving a reduction in the cost of the laminate type evaporator.

The flat tubes 302 and 502 used in the laminate type evaporators of Embodiments 3 and 5 may also be formed by folding linearly symmetrical molded plate portions as described above.

Embodiment 7

Figure 7:
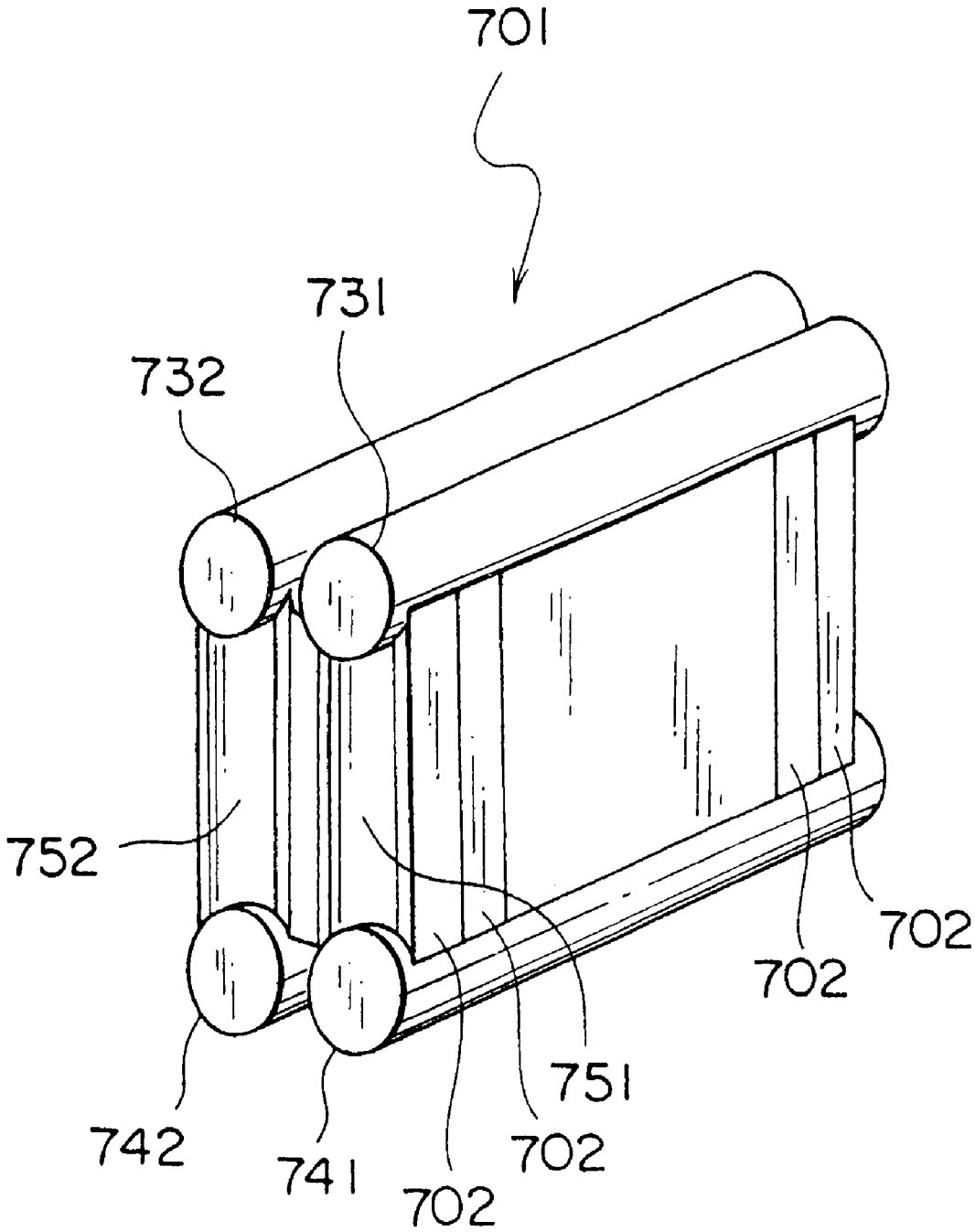
FIG. 7 is a perspective view showing a flat tube unit used in a laminate type evaporator according to Embodiment 7.

In the laminate type evaporator of Embodiment 7, the laminated flat tubes 2 used in the laminate type evaporators of Embodiments 1 through 6 are formed as a flat tube unit 701 as shown in FIG. 7.

Figure 8:
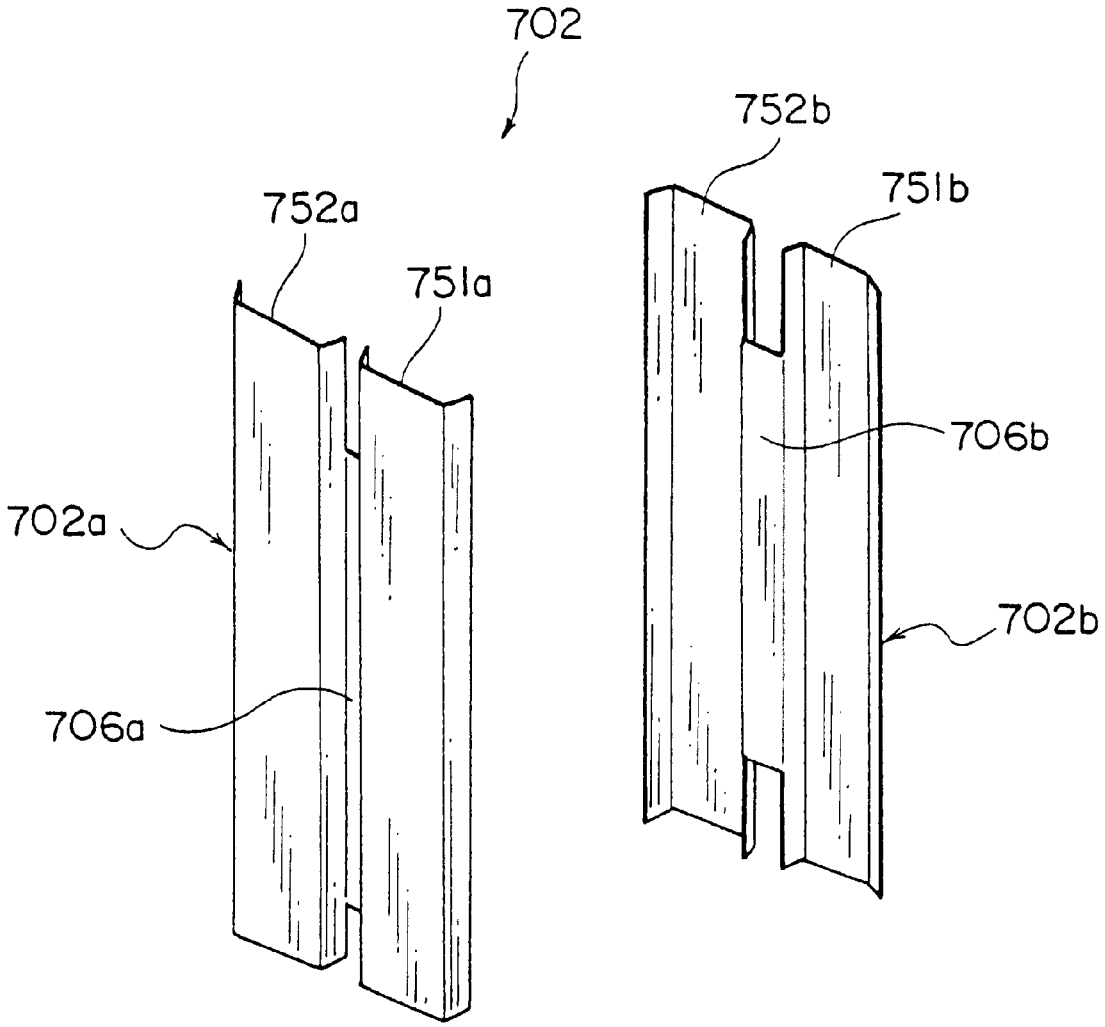
FIG. 8 is an exploded perspective view of a flat tube used in the flat tube unit of FIG. 7.
Figure 9:
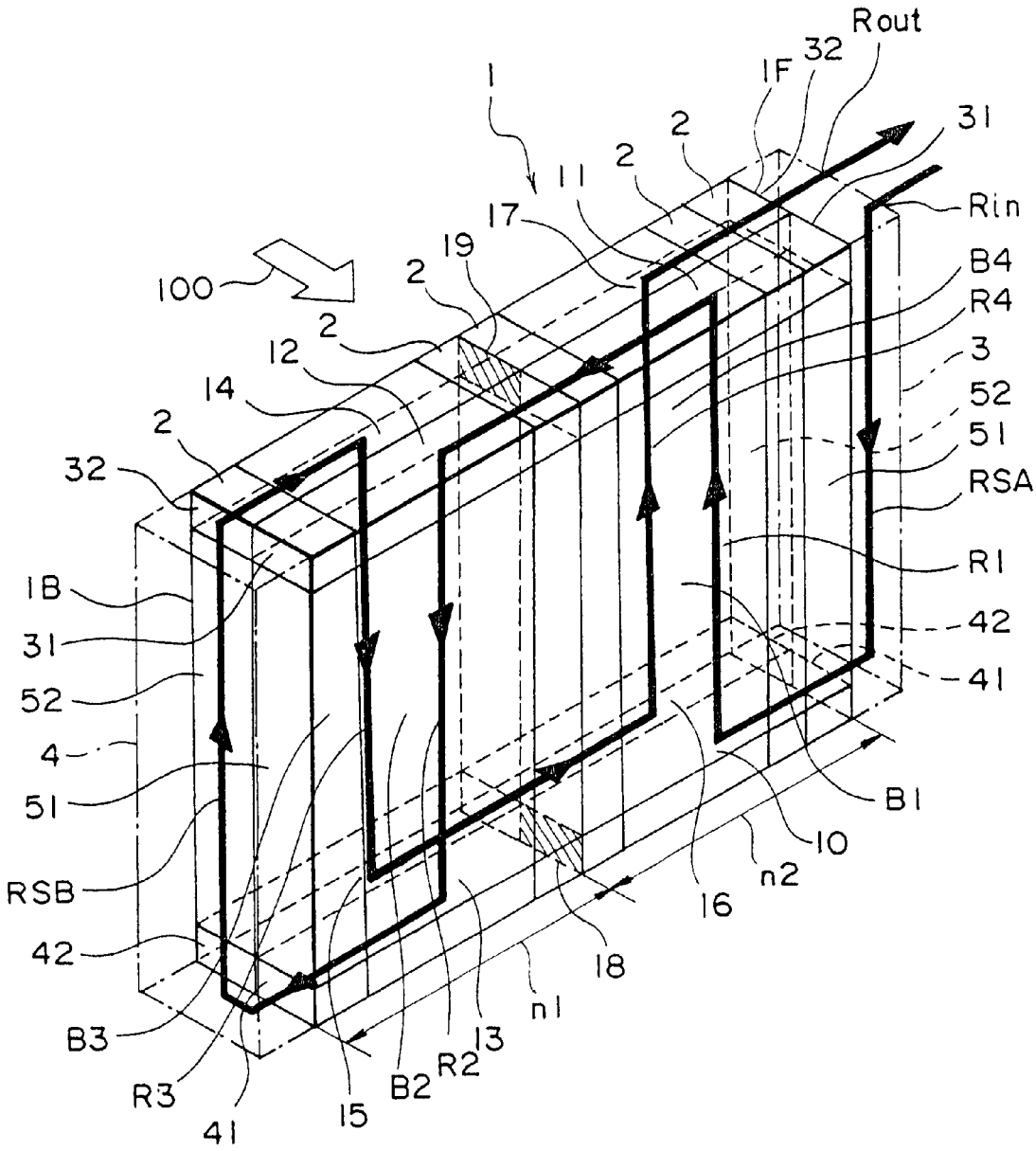
FIG. 9 is a perspective view showing the refrigerant flow passage construction of a conventional laminate type evaporator.

The flat tube unit 701 is composed of a flat tube group formed by laminating flat tubes 702 as shown in FIG. 8, and a first upper tank member 731, a second upper tank member 732, a first lower tank member 741, and a second lower tank member 742 which are in the form of pipes.

The flat tube 702 is formed by joining together a molded plate 702*a* having refrigerant flow passage forming portions 751*a* and 752*a* separated by a partition groove 706*a* and a molded plate 702*b* having refrigerant flow passage forming portions 751*b* and 752*b* separated by a partition groove 706*b*, forming within it a first refrigerant flow passage 751 and a second refrigerant flow passage 752.

The flat tubes 702 thus formed are laminated together, and the tank members 731, 732, 741, and 742 are fitted onto the upper and lower end portions of the first and second refrigerant flow passages 751 and 752.

Due to this arrangement, the tank portions are produced separately from the flat tubes 702, so that when forming the molded plates 702*a* and 702*b* by press molding, there is no need to perform deep drawing for forming the tank portions. Thus, a reduction in wall thickness, cracking etc. in performing deep drawing on the thin plates are not involved, thereby reducing the possibility of a reduction in the strength of the flat tubes 702.

While in the laminated evaporators of Embodiments 1 through 7, the refrigerant outlet Rout is arranged on the upstream side of the refrigerant inlet Rin with respect to the flowing direction 100 of the external fluid, it is also possible to arrange the refrigerant inlet Rin on the upstream side of the refrigerant outlet Rout with respect to the flowing direction 100 of the external fluid.

What is claimed is:

1. A laminate type evaporator in which a large number of refrigerant tubes including at least a pair of first and second refrigerant flow passages are laminated together, comprising:

a refrigerant tube group in which a pair of first and second upper tank portions are respectively arranged at one end of the first and second refrigerant flow passages and in which a pair of first and second lower tank portions are respectively arranged at the other end of the first and second flow passages;

a refrigerant inlet arranged on the first upper tank portion side of the refrigerant tube at one end of the refrigerant tube group;

a refrigerant outlet arranged on the second upper tank portion side of the refrigerant tube at said one end;

a first side refrigerant passage communicating the refrigerant inlet with the first lower tank portion of the refrigerant tube at said one end;

a second side refrigerant passage communicating the first upper tank portion with the second upper tank portion of the refrigerant tube at the other end of the refrigerant tube group;

a third side refrigerant passage communicating the first lower tank portion with the second lower tank portion of the refrigerant tube at said other end;

a first partition portion arranged in the first lower tank portions of the refrigerant tube group; and a second partition portion arranged in the second upper tank portions of the refrigerant tube group, wherein the first partition portion and the second partition portion are arranged such that they divide the refrigerant tube group into three refrigerant flow passage groups sequentially circulating all refrigerant introduced from the refrigerant inlet from the first lower tank portion of the refrigerant tube at said one end through all three refrigerant flow passage groups to the second upper tank portion of the refrigerant tube at said one end.

2. A laminate type evaporator according to claim 1, wherein the first partition portion is arranged nearer to the refrigerant inlet side than a position which leads to inclusion of approximately ⅔ of the refrigerant tubes, and wherein the second partition portion is arranged farther away from the refrigerant outlet side than said a position which leads to inclusion of approximately ⅔ of the refrigerant tubes.

3. A laminated evaporator according to claim 1, wherein the width of the second refrigerant flow passage of said refrigerant tube is larger than the width of the first flow passage thereof.

4. A laminate type evaporator according to claim 1, wherein inner fins are provided in the first and second refrigerant flow passages of said refrigerant tube.

5. A laminate type evaporator according to claim 1, wherein protrusions are formed on the inner surfaces of the first and second refrigerant passages of said refrigerant tube.

6. A laminate type evaporator according to claim 1, wherein said refrigerant tube is formed by integrally molding a linearly symmetrical member and folding it along the symmetry line.

7. A laminate type evaporator according to claim 1, wherein said refrigerant tube has at either end thereof a pair of said four tank portions.

8. A laminate type evaporator according to claim 1, wherein said four tank portions are constructed by four tank members provided one pair at either end of the laminated refrigerant tubes separately from the refrigerant tubes.

9. A laminate type evaporator in which a large number of refrigerant tubes including at least a pair of first and second refrigerant flow passages are laminated together, comprising:

a refrigerant tube group in which a pair of first and second upper tank portions are respectively arranged at one end of the first and second refrigerant flow passages and in which a pair of first and second lower tank portions are respectively arranged at the other end of the first and second flow passages;

a refrigerant inlet arranged on the first upper tank portion side of the refrigerant tube at one end of the refrigerant tube group;

a refrigerant outlet arranged on the second upper tank portion side of the refrigerant tube at said one end;

a first side refrigerant passage communicating the refrigerant inlet with the first lower tank portion of the refrigerant tube at said one end;

a second side refrigerant passage communicating the first upper tank portion with the second upper tank portion of the refrigerant tube at the other end of the refrigerant tube group;

a third side refrigerant passage communicating the first lower tank portion with the second lower tank portion of the refrigerant tube at said other end;

a first partition portion arranged in the first lower tank portions of the refrigerant tube group; and a second partition portion arranged in the second upper tank portions of the refrigerant tube group, wherein the first partition portion and the second partition portion are arranged such that they divide the refrigerant tube group into three refrigerant flow passage groups sequentially circulating refrigerant introduced from the refrigerant inlet from the first lower tank portion of the refrigerant tube at said one end to the second upper tank portion of the refrigerant tube at said one end, and wherein the first partition portion and the second partition portion are arranged at positions such that approximately ⅔ of the total laminated refrigerant tubes exist between them and the side surface portion on the refrigerant inlet side.

* * * * *